US011027958B2

(12) United States Patent
Kalina

(10) Patent No.: US 11,027,958 B2
(45) Date of Patent: Jun. 8, 2021

(54) LIQUID DISTRIBUTION SYSTEM

(71) Applicant: Loren Kalina, Mesa, AZ (US)

(72) Inventor: Loren Kalina, Mesa, AZ (US)

( * ) Notice: Subject to any disclaimer, the term of this patent is extended or adjusted under 35 U.S.C. 154(b) by 0 days.

(21) Appl. No.: 16/299,051

(22) Filed: Mar. 11, 2019

(65) Prior Publication Data

US 2020/0062567 A1 Feb. 27, 2020

Related U.S. Application Data

(60) Provisional application No. 62/765,360, filed on Aug. 23, 2018.

(51) Int. Cl.

| | |
|---|---|
| ***B67C 11/02*** | (2006.01) |
| ***B65B 39/00*** | (2006.01) |
| ***B65B 3/06*** | (2006.01) |
| ***B65B 67/02*** | (2006.01) |

(52) U.S. Cl.

CPC ..... *B67C 11/02* (2013.01); *B65B 3/06* (2013.01); *B65B 39/007* (2013.01); *B65B 67/02* (2013.01); *B65B 2039/009* (2013.01); *B67D 2210/00068* (2013.01)

(58) Field of Classification Search

CPC . B65B 39/00; B65B 2039/009; B65B 39/007; B65B 39/06; B65B 3/06; B65B 67/02; B67C 11/02; B67C 11/00; B67D 2210/00068

USPC ..... 141/237, 247, 364, 331

See application file for complete search history.

(56) References Cited

U.S. PATENT DOCUMENTS

| | | | | |
|---|---|---|---|---|
| 2,447,281 | A * | 8/1948 | Schneir | B67C 11/02 141/237 |
| 3,566,929 | A * | 3/1971 | Mead | B65B 39/06 141/237 |
| 3,693,673 | A * | 9/1972 | Oates | B65B 39/00 141/237 |
| 4,800,934 | A * | 1/1989 | Boissoneault | B67C 11/02 141/106 |
| 7,308,919 | B1 * | 12/2007 | Zavala | B65B 39/00 141/198 |
| 8,726,949 | B1 * | 5/2014 | Poire | B67C 11/02 141/338 |
| 9,010,388 | B2 * | 4/2015 | Sanchez | B65B 67/02 141/331 |
| 2017/0349366 | A1 * | 12/2017 | Link | B67C 11/02 |

* cited by examiner

*Primary Examiner* — Timothy P. Kelly
*Assistant Examiner* — Christopher M Afful
(74) *Attorney, Agent, or Firm* — Morgan Law Offices, PLC

(57) ABSTRACT

A liquid distribution system is provided that allows for filling multiple liquid-holding containers simultaneously and evenly. The system includes a hollow-bodied unit with a plurality of bowl-shaped channels and corresponding spouts that is structured such that liquids can be collected and drained out at one time into multiple bottles or other containers situated below the hollow-bodied unit and held in a structure unit below.

14 Claims, 4 Drawing Sheets

LIQUID DISTRIBUTION SYSTEM

CROSS-REFERENCE TO RELATED APPLICATIONS

This application claims the benefit of U.S. Provisional Application No. 62/765,360, filed on Aug. 23, 2018, the subject matter of which is incorporated herein by reference.

TECHNICAL FIELD

The present disclosure relates to a system for filling multiple liquid-holding containers simultaneously and evenly.

BACKGROUND

There are a variety of bottles or other containers used to carry liquids especially water, soda, juices and other beverages to consume. These can be multipack plastic bottles, or refillable bottles. There are several problems with these liquid transport structures. One is the waste the plastic bottles create. These single-use bottles produce much garbage that has a negative environmental impact. Buying single use plastic bottle multipacks also add costs for continued repurchase. Another is the lack of ease in transporting these multipacks as they are heavy to move and take up considerable trunk space. Even more environmentally friendly refillable bottles have a disadvantage in that they must be filled one container at a time, which wastes time and effort. Accordingly, it would be desirable to provide a system that overcomes these and other deficiencies.

SUMMARY

The present disclosure, as briefly described, is a system for filling multiple liquid-holding containers simultaneously and evenly. The system includes a hollow-bodied portion with a plurality of bowl-shaped channels and corresponding spouts that is designed such that liquids can be collected and drained out at one time into multiple bottles or other containers situated below the hollow-bodied unit and held in a structure unit below.

DETAILED DESCRIPTION OF EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

Figure 1:
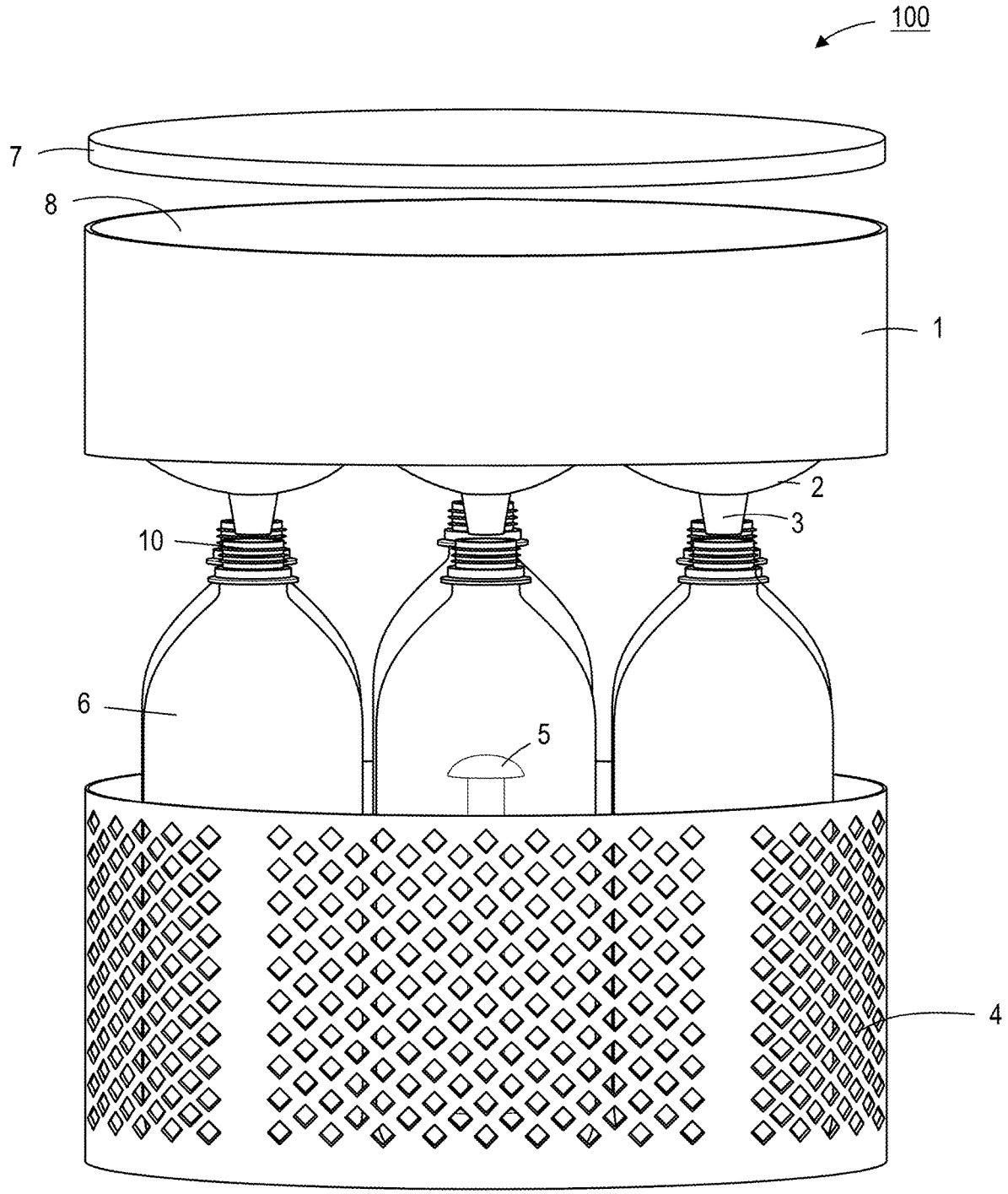
FIG. 1 shows a perspective view of an example liquid distribution system, according to an example embodiment of the disclosure.
Figure 2:
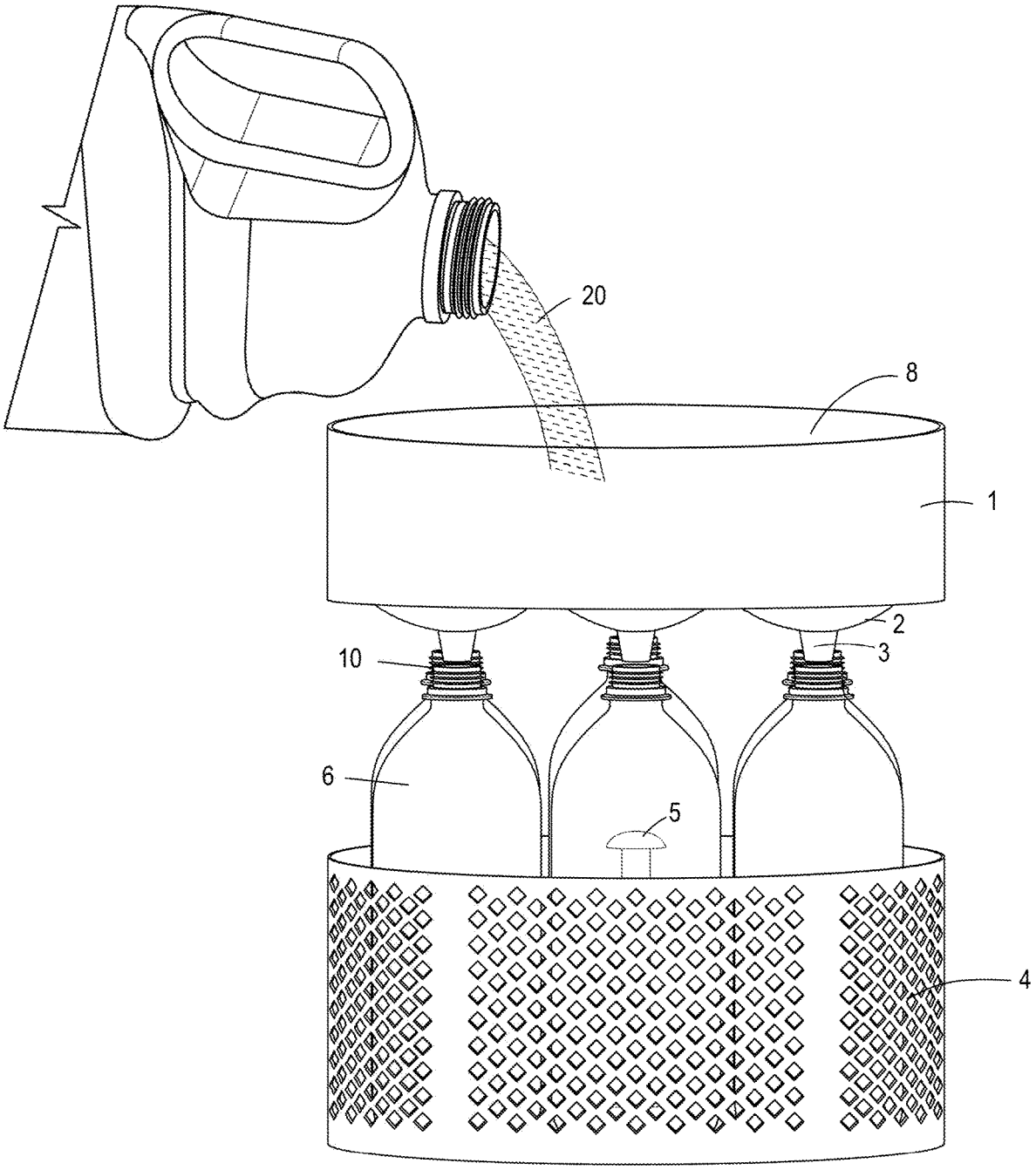
FIG. 2 shows the liquid distribution system of FIG. 1 in use.

Referring to FIG. 1, an example liquid distribution system 100, according to an example embodiment, is illustrated. The liquid distribution system 100 includes a hollow-bodied portion 1 which is a where liquid 20 is poured into an interior 8 thereof (FIG. 2). The liquid 20 can include water, soda, juices, energy drinks, coffee, and any variety of beverages to be contained and distributed. This hollow-bodied portion 1 can be made of a suitable non-corrosive material such as plastic, glass, stainless steel, aluminum, or various woods, for example. The hollow-bodied portion 1 can be constructed in a variety of proportions and dimensions, and can assume many different geometric shapes that can hold the liquid 20 to be collected.

Once the liquid 20 is collected in the hollow-bodied portion 1, the liquid 20 will flow due to gravity into a plurality of bowl-shaped (concave) channels 2 that extend from the bottom of the hollow-bodied container 1. The liquid 20 will continue flowing through spouts 3 and into corresponding openings 10 of liquid holding containers 6 to be filled at the same time. In preferred embodiments, the bowl-shaped channels 2 with the spouts 3 will be substantially identical to one another. Optional embodiments include a cover 7 for the top of the hollow-bodied portion 1, as shown. This cover 7 can have a variety of shapes to correspond to the shape of the hollow bodied container 1.

Returning to FIGS. 1-2, the illustrations also show an embodiment of a liquid-container corralling structure 4. This liquid-container corralling structure 4 should preferably be made of a suitable non-corrosive material such as steel but can also be made from another non-corrosive material, including various plastics, glass or wood that can enclose the liquid-holding containers 6 to be filled. The liquid-holding containers 6 can bundle various types of plastic or glass bottles, for example. The amount of liquid 20 to be poured into the hollow-bodied portion 1 should not exceed the total of the capacities of the liquid-holding containers 6; otherwise some of the liquid will spill out. However, the user can observe the liquid-holding containers 6 being filled as he or she pours the liquid 20, and will be able to stop pouring the liquid 20 once the liquid in each liquid-holding container 6 reaches the top. The liquid-container corralling structure 4 can be constructed in a variety of proportions and dimensions, and be designed in various geometric shapes to hold the liquid-holding containers 6. These liquid-holding containers 6 can have a variety of volumes proportional to the amount of liquid to be filled into each one at the same time. As a non-limiting example, six typical plastic water bottles can be filled using about one gallon of water. Additionally, a handle 5 can be disposed at the approximate center of the structure 4 to facilitate carrying the device. By placing the handle at the center, mass is evenly distributed making it less likely to cause spillage. It is to be understood that the handle 5 is optional, and also that a handle with a different structure can alternatively, or additionally, be incorporated into the design. Although a liquid-container corralling structure 4 is disclosed herein, it is to be understood that in some embodiments, the liquid-container corralling structure 4 would not be used. Instead, the hollow-bodied container 1 would simply be placed on top of the liquid-holding containers 6 with corresponding spouts matching openings 10 of the liquid-holding containers 6.

Figure 3:
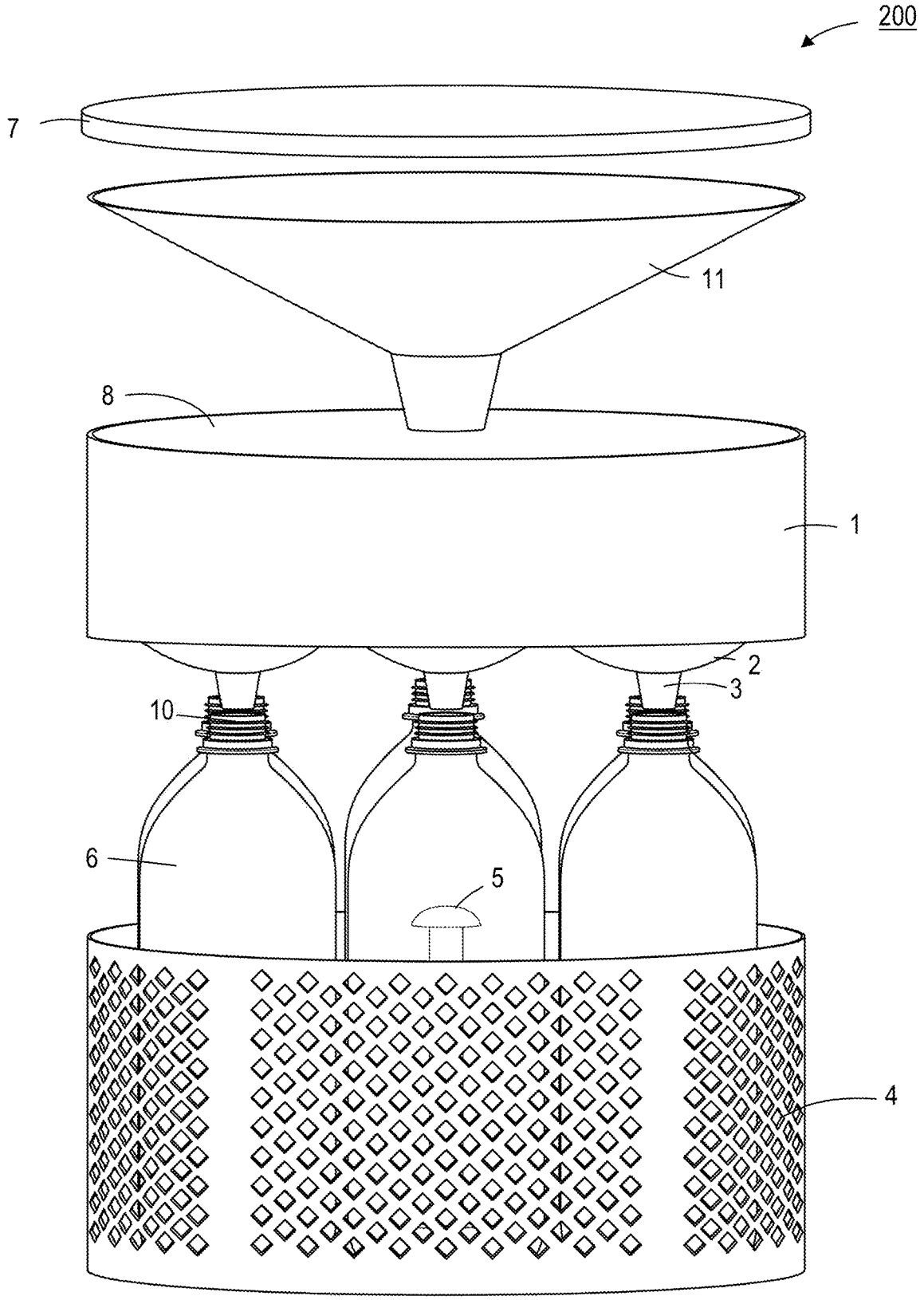
FIG. 3 shows a perspective view of an example liquid distribution system, according to another example embodiment of the disclosure.

Referring to FIG. 3, an example liquid distribution system 200, according to another example embodiment, is illustrated. The liquid distribution system 100 and the liquid distribution system 200 are substantially the same, the difference being that the liquid distribution system 200 further includes a funnel 11. Although the funnel 11 is depicted for illustrative purposes as being above the hollow-bodied portion 1, it is to be understood that the funnel 11 would be inserted into the interior 8 of the hollow-bodied portion 1. The main purpose of the funnel is more accurately direct the poured-in liquid 20 to the approximate center of the hollow-bodied portion 1 so that it is evenly distributed to the bowl-shaped channels 2, so as to more evenly fill the liquid holding containers 6. It is to be understood that a funnel shaped differently from the illustrated funnel 11 can be used if it is functionally the same or similar.

Figure 4:
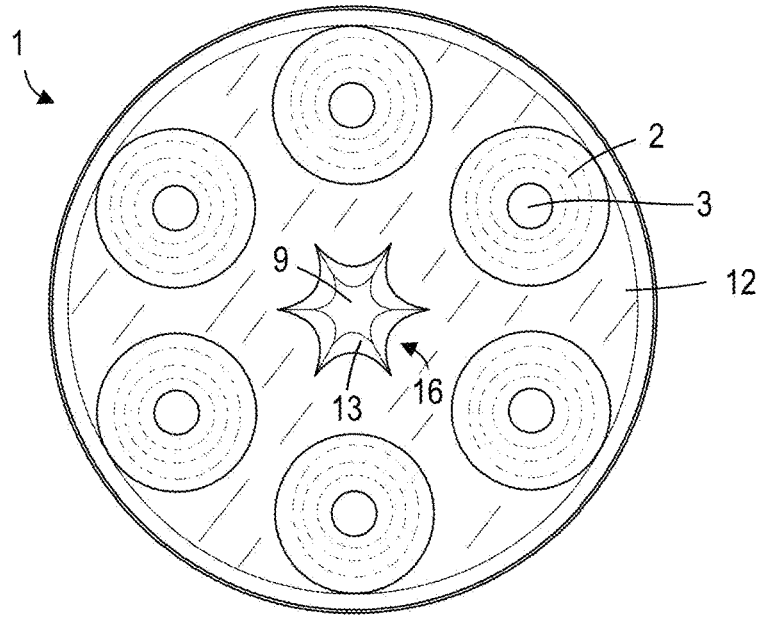
FIG. 4 shows a top plan view of an example hollow-bodied portion, according to example embodiments of the disclosure.

FIG. 4 shows a top plan view of an example hollow-bodied portion 1, according to example embodiments of the disclosure. As shown, a plurality of the bowl-shaped channels 2 with accompanying spouts 3 are disposed in the floor of the hollow-bodied portion 1. At the approximate center, a flow regulator 16 is disposed. The flow regulator 16 is comprised of topside 9 and a plurality of sloping sides 13. As shown, there are six sloping sides 13, each directing an approximately equal amount of the poured-in liquid 20 to one of the six bowl-shaped channels 2. The remaining part of the floor 12 of the hollow-bodied portion 1 can be flat or have a slight downward slope (grade) toward the outer edge of the hollow-bodied portion 1.

Figure 5:
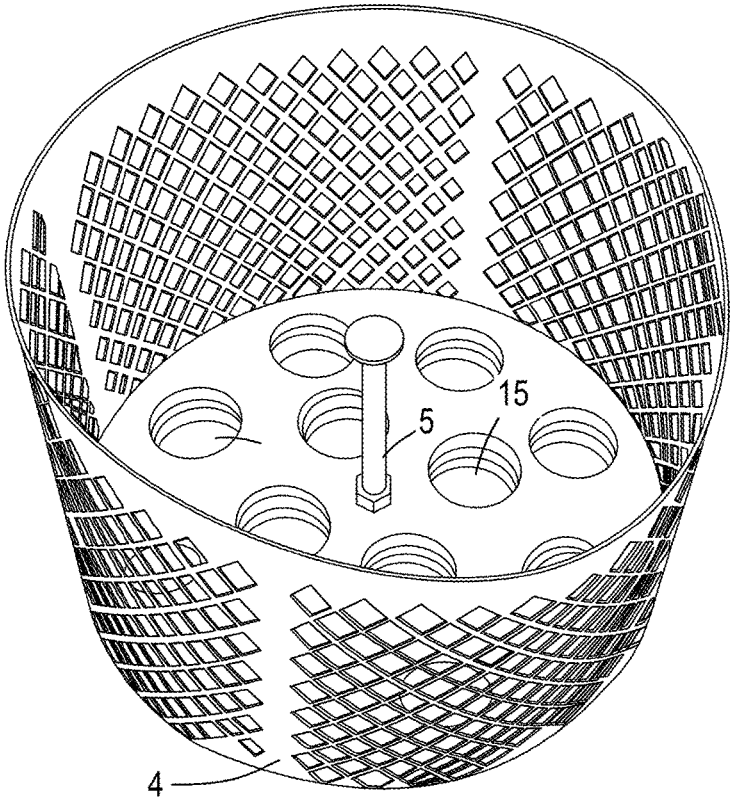
FIG. 5 shows a perspective side view of an example bottle-corralling structure, according to example embodiments of the disclosure.

FIG. 5 shows a perspective view of an example liquid-container corralling structure 4, according to example embodiments of the disclosure. As shown, the flooring of the liquid-holding-container corralling structure 4 can include drains 15 that allow spilled liquid to drain from flooring. The number and placement of the drains 15 can vary from the illustrated embodiment. For example, the drains can includes a layer having drainage holes disposed upon a hollow base. In some embodiments, drainage will not be provided. In such cases, the device can be made from a water-resistant material such as plastic or the like so spilled liquid does not do any damage.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A liquid distribution system, comprising:

a hollow-bodied portion having an open top, a bottom, and one or more side walls running vertical from the top to the bottom;

a plurality of bowl-shaped channels extending from the bottom of the hollow-bodied portion;

a plurality of spouts, each disposed on distal ends of respective bowl-shaped channels;

a liquid container corralling structure capable of bundling a plurality of liquid-holding containers, the bundled liquid containers arranged such that openings of the liquid-holding containers are each matched with respective ones of the spouts; and a flow regulator situated in the approximate center of the bottom of the hollow-bodied portion, the flow regulator having a star-shaped topside and a plurality of sloping sides extending from the topside, each directing an approximately equal amount of poured-in liquid to one of the bowl-shaped channels;

wherein liquid poured into the open top of the hollow-bodied portion pours out from the spouts;

wherein the hollow bodied portion is disposed above the liquid container corralling structure; and.

2. The liquid distribution system of claim 1, wherein the bowl-shaped channels are concave shaped.

3. The liquid distribution system of claim 1, further comprising a liquid container corralling structure.

4. The liquid distribution system of claim 3, wherein the liquid container corralling structure is capable of bundling a plurality of liquid-holding containers.

5. The liquid distribution system of claim 3, wherein the bundled liquid containers are arranged such that openings of the liquid-holding containers are each matched with respective ones of the spouts.

6. The liquid distribution system of claim 3, wherein flooring of the liquid container corralling structure includes drains.

7. The liquid distribution system of claim 1, further comprising a funnel that is inserted into an interior of the hollow-bodied portion.

8. The liquid distribution system of claim 1, further comprising drains disposed within the liquid container corralling structure.

9. The liquid distribution system of claim 1, further comprising a funnel that is inserted into an interior of the hollow-bodied portion, the funnel directing poured-in liquid to the topside of the flow regulator.

10. The liquid distribution system of claim 1, further including a cover.

11. A liquid distribution system, comprising:

a hollow-bodied portion having a top, a bottom, and one or more side walls running vertical from the top to the bottom;

a plurality of bowl-shaped channels extending from the bottom of the hollow-bodied portion;

a plurality of spouts, each disposed on distal ends of respective bowl-shaped channels; and a liquid container corralling structure that bundles a plurality of liquid holding containers;

a flow regulator situated in the approximate center of the bottom of the hollow-bodied portion, the flow regulator having a star-shaped topside and a plurality of sloping sides extending from the topside, each directing an approximately equal amount of poured-in liquid to one of the bowl-shaped channels;

wherein liquid poured into the top of the hollow-bodied portion pours out from the spouts and into each of the liquid holding containers; and wherein the hollow bodied portion is disposed above the liquid container corralling structure.

12. The liquid distribution system of claim 11, wherein the bowl-shaped channels are concave shaped.

13. The liquid distribution system of claim 11, further including a cover.

14. The liquid distribution system of claim 11, further comprising a funnel that is inserted into an interior of the hollow-bodied portion.

* * * * *